US007059670B2

(12) United States Patent
Mills et al.

(10) Patent No.: US 7,059,670 B2
(45) Date of Patent: Jun. 13, 2006

(54) STACKABLE CHAIR-DESK FRAME

(75) Inventors: Robert J. Mills, Torrance, CA (US); Peter Glass, Arroyo Grande, CA (US)

(73) Assignee: Virco Mgmt. Corporation, Torrance, CA (US)

( * ) Notice: Subject to any disclaimer, the term of this patent is extended or adjusted under 35 U.S.C. 154(b) by 0 days.

(21) Appl. No.: 10/956,785

(22) Filed: Oct. 1, 2004

(65) Prior Publication Data

US 2006/0071515 A1 Apr. 6, 2006

(51) Int. Cl.
*A47B 39/00* (2006.01)
*A47B 83/02* (2006.01)
*A47C 3/04* (2006.01)

(52) U.S. Cl. ..... 297/174 R; 297/160; 297/162; 297/170; 297/239

(58) Field of Classification Search ..... 297/239, 297/160, 162, 174 R, 170
See application file for complete search history.

(56) References Cited

U.S. PATENT DOCUMENTS 120,234 A * 10/1871 Bligh ..... 297/174 R
1,408,114 A 2/1922 Mathieu
1,664,356 A 3/1928 Dellert
1,716,746 A 6/1929 Tyner
1,753,623 A 4/1930 Porche
1,758,826 A 5/1930 Dellert
1,825,368 A 9/1931 Scully
1,911,224 A 5/1933 Dellert
1,966,343 A 7/1934 Hallowell et al.
1,989,426 A 1/1935 Pollack
2,098,888 A 11/1937 Schadler
2,184,470 A 12/1939 Primavera
2,362,426 A 11/1944 Wyatt
D170,005 S * 7/1953 Chapman et al. ..... 297/170 X
2,699,814 A 1/1955 Kahn
2,722,965 A 11/1955 Chapman et al.
2,747,654 A 5/1956 Chapman et al.
D183,439 S * 8/1958 Williams ..... 297/170 X
2,874,755 A 2/1959 Smith
2,893,469 A 7/1959 Eames et al.
D186,322 S * 10/1959 Carlson ..... 297/170 X
2,925,123 A 2/1960 Morgan
2,936,024 A 5/1960 Hendrickson
2,952,300 A 9/1960 Cohen
2,970,635 A 2/1961 Fields
2,979,117 A * 4/1961 Barecki et al. ..... 297/170
2,997,339 A 8/1961 Wilson
3,020,086 A * 2/1962 Barber ..... 297/170
3,025,105 A 3/1962 Nash
3,028,197 A 4/1962 Wilson
3,031,227 A 4/1962 Buren, Jr.
3,053,493 A 9/1962 Stafford
3,057,661 A 10/1962 Moxley (Continued)

*Primary Examiner*—Rodney B. White
(74) *Attorney, Agent, or Firm*—Denton L. Anderson; Sheldon & Mak PC; Robert M. Hupe

(57) ABSTRACT

A chair-desk frame has a forward portion and a rearward portion. The forward portion has a pair of front legs and a desktop support structure. The rearward portion has a pair of rear legs and a seat support structure. The chair-desk frame includes at least three upper stacking contact points and at least three lower stacking contacting points, all of which are disposed so that a plurality of identical chair-desk frames can be vertically stacked on top of one another in a stable and generally vertical orientation.

28 Claims, 14 Drawing Sheets

U.S. PATENT DOCUMENTS 3,061,369 A * 10/1962 Haunost ..... 297/174 R X
3,095,236 A 6/1963 Klassen
3,156,498 A * 11/1964 Blodee ..... 297/239 X
3,203,731 A 8/1965 Krueger
3,212,816 A * 10/1965 Nordmark ..... 297/170
3,216,764 A * 11/1965 Junkunc ..... 297/239 X
3,216,765 A * 11/1965 Junkunc ..... 297/239 X
3,236,559 A 2/1966 Kaufman
RE25,985 E 3/1966 Klassen
3,246,927 A 4/1966 Klassen
3,291,523 A 12/1966 Krueger
3,316,016 A 4/1967 Petersen
3,380,778 A * 4/1968 Barecki ..... 297/239 X
3,755,853 A 9/1973 Barile
4,057,288 A 11/1977 Schwartz et al.
4,749,232 A 6/1988 Guichon
4,906,046 A 3/1990 Kleinklaus
5,044,691 A 9/1991 Guichon
D337,003 S 7/1993 Rowland
5,474,356 A * 12/1995 Johnson ..... 297/174 R X
D390,024 S 2/1998 DeJule
D393,757 S 4/1998 Breen
5,762,396 A 6/1998 Barile
D405,285 S 2/1999 Balderi et al.
5,884,966 A * 3/1999 Hill et al. ..... 297/170
D411,928 S 7/1999 Ritch et al.
D412,410 S 8/1999 Leib
5,997,084 A 12/1999 Barile, Jr. et al.
6,010,186 A * 1/2000 Tsay ..... 297/174 R X
6,030,037 A 2/2000 Ritch et al.
6,102,475 A * 8/2000 Hamann ..... 297/174 X
6,106,061 A 8/2000 Caruso et al.
6,142,566 A 11/2000 Ritch et al.
6,286,901 B1 9/2001 Ritch et al.
6,412,869 B1 7/2002 Pearce
D461,327 S 8/2002 Pearce et al.
6,662,731 B1 12/2003 Teppo et al.
6,669,282 B1 * 12/2003 Piretti ..... 297/239 X

* cited by examiner

FIG. 13
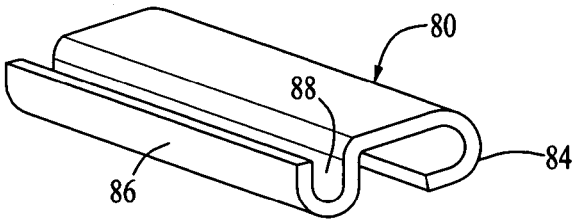
FIG. 15
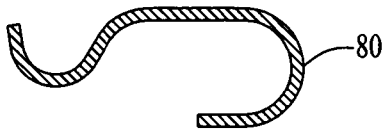
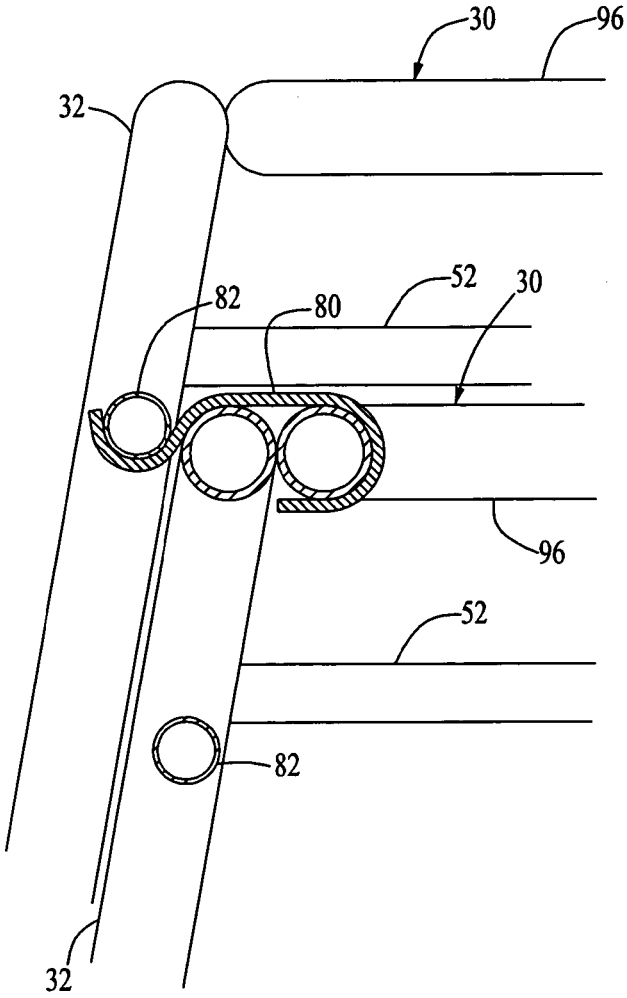
FIG. 14
FIG. 16A
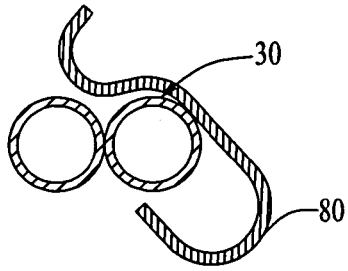
FIG. 16B
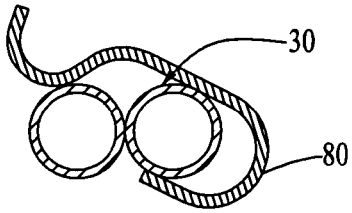
FIG. 16C
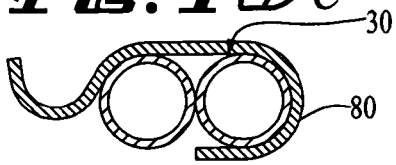

STACKABLE CHAIR-DESK FRAME

FIELD OF THE INVENTION

This invention relates generally to furniture and, more specifically, to chair-desks and chair-desk frames.

BACKGROUND OF THE INVENTION

Chair-desks, wherein a desk top and a seating surface are combined in a single, integral unit, have long been in common use as student desks in classroom environments. Typically, chair-desks comprise a tubular frame having a forward portion and a rearward portion. The forward portion defines a pair of front legs and a desk top support structure. The rearward portion comprises a pair of rear legs and a seat support structure. The forward portion and the rearward portion are typically connected to one another by one or more connecting elements.

Chair-desks are very awkward to store and to ship because of their large overall volume and irregular shape. Consequently, the cost to the manufacturer to store and ship chair-desks and the cost to the consumer (typically a school district) to store chair-desks is very large. Accordingly, there is a long-felt need in the industry for a method for shipping and storing chair-desks which would greatly reduce costs.

SUMMARY

The invention satisfies this need. The invention is a stackable chair-desk frame and a method for moving a plurality of chair-desk frames.

In one embodiment, the chair-desk frame comprises (a) a forward portion having a desk top support structure and a pair of front legs, the pair of front legs defining a front leg base connection line extending between the midpoints of the pair of front legs at the base elevation; and (b) a rearward portion attached to the forward portion, the rearward portion having a seat support structure and a pair of rear legs, the pair of rear legs defining a rear leg base connection line extending between the center lines of the pair of rear legs at the base elevation; wherein the chair-desk frame defines (i) a base center line extending between the midpoints of the front leg base connection line and the rear leg base connection line, and (ii) a central base point at the midpoint of the base center line; and wherein the chair-desk frame further comprises at least three upper stacking contact points and at least three lower stacking contact points, all of which are disposed so that a plurality of identical chair-desk frames can be vertically stacked one on top of the other such that (i) the base elevations of each chair-desk in the stack is separated from the base elevation of an adjacent chair-desk by less than 45% of the maximum elevation, and (ii) the locations of all central base points in the stacks fall along a generally vertical line which deviates from the vertical in a forward direction by less than 30°, in a direction towards either side by less than 10° and in a rearward direction by less than 30°.

In a second embodiment, the chair-desk frame comprises (a) a forward portion having a pair of front legs and a desk top support structure, the pair of front legs comprising a first side front leg and a second side front leg, the second side front leg having a distal-most surface; (b) a rearward portion having a pair of rear legs and a seat support structure; (c) a connecting element for connecting the forward portion to the rearward portion, the connecting element having a distal-most surface, the distal-most surface of the connecting element and the distal-most surface of the second side front leg defining a tangential plane; and (d) a side brace connecting the second side front leg to the connecting element, the side brace being disposed along or outwardly of the tangential plane; wherein the chair-desk frame is capable of stacking with identical chair-desk frames to form a generally vertical chair-desk frame stack comprising at least three identical chair-desk frames.

In yet another embodiment of the invention, the chair-desk frame comprises (a) a forward portion having a pair of front legs and a desk top support structure, the pair of front legs comprising a first side front leg and a second side front leg, the second side front leg having a distal-most surface; (b) a rearward portion having a pair of rear legs and a seat support structure, the pair of rear legs comprising a first side rear leg and a second side rear leg, the second side rear leg having an distal-most surface, the distal-most surface of the second side rear leg and the distal-most surface of the second side front leg defining a tangential plane; and (c) a side brace connecting the second side front leg to the second side rear leg, the side brace being disposed along or outwardly of the tangential plane; wherein the chair-desk frame is capable of stacking with identical chair-desk frames to form a generally vertical chair-desk frame stack comprising at least three identical chair-desk frames.

DRAWINGS

These and other features, aspects and advantages of the present invention will become better understood with reference to the following description, appended claims and accompanying drawings where:

FIG. 13 is an perspective view of a stabilizer element useable in the invention;

FIG. 14 is a detail view of the use of the stabilizer in the stack illustrated in FIG. 12;

FIG. 15 is a cross-sectional view of the stabilizer illustrated in FIG. 13; and FIG. 16A–16C are cross-sectional detail views showing the installation of the stabilizer onto the desk top support structure of the chair-desk frame illustrated in FIG. 11.

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figure 1:
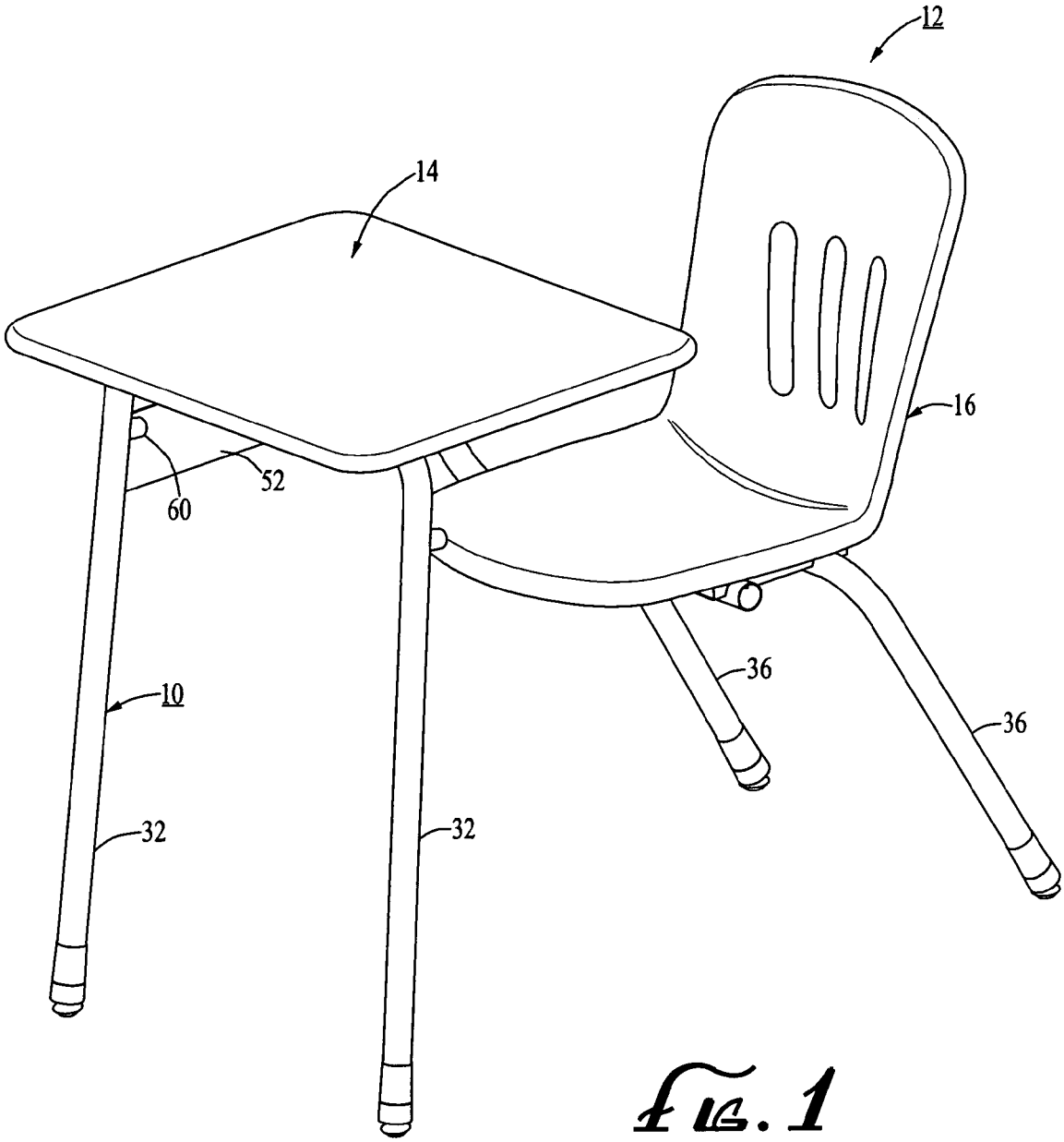
FIG. 1 is an perspective view of a chair-desk having features of the invention.
Figure 2:
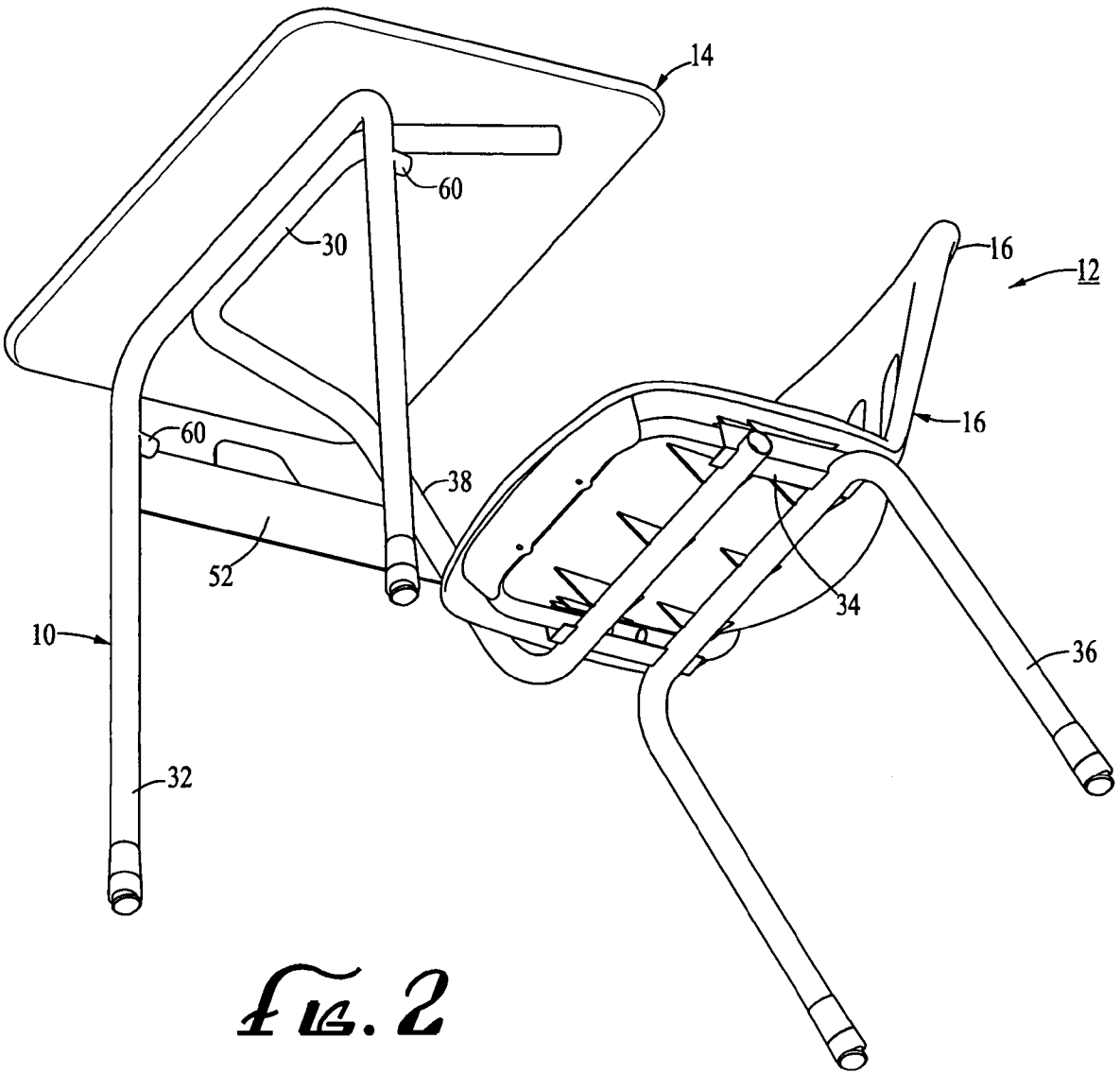
FIG. 2 is a perspective view showing the underside of the chair-desk illustrated in FIG. 1.

The invention is a stackable chair-desk frame 10 used in a chair-desk 12, such as illustrated in FIGS. 1 and 2. The chair-desk 12 comprises the chair-desk frame 10 to which is attached a desk top 14 and a seat 16.

One embodiment of the chair-desk frame 10 is illustrated in FIGS. 3–6. The chair-desk frame 10 has a base elevation 18, a maximum elevation 20, a forward end 22, and a rearward end 24, a forward portion 26 and a rearward portion 28. The forward portion 26 comprises a desk top support structure 30 and a pair of front legs 32. The desk top support structure 30 is supported by both of the pair of front legs 32. The rearward portion 28 comprises a seat support structure 34 and a pair of rear legs 36. The upper portion of the front legs 32 extend upwardly above the elevation of the seat support structure 34. The forward portion 26 is attached to the rearward portion 28 by a connecting element 38. Typically, the chair-desk frame 10 is fashioned from tubular steel.

As shown in the embodiments illustrated in the drawings, the front legs 32 extend slightly in a forwardly direction, although the front legs 32 can be vertical. Likewise, the rear legs 36 extend rearwardly. The rear legs 36 preferably extend rearwardly at a sufficient angle to make it difficult for a student to tip the chair-desk 12 backwards by leaning against the back of the seat 16. However, it is preferable that the rear legs 36 do not extend rearwardly to an excessive extent, thus to minimize the footprint of the chair-desk 12 and to minimize the danger of the rear legs 36 becoming a tripping hazard.

The chair-desk frame 10 has a first side 40 and a second side 42. The first side 40 is open so as to allow a user of the chair-desk 12 to have ingress and egress from the seat 16 of the chair-desk 12. The second side 42 of the chair-desk frame 10 is closed, as the ingress and egress is prevented by the connecting element 38.

Figure 3:
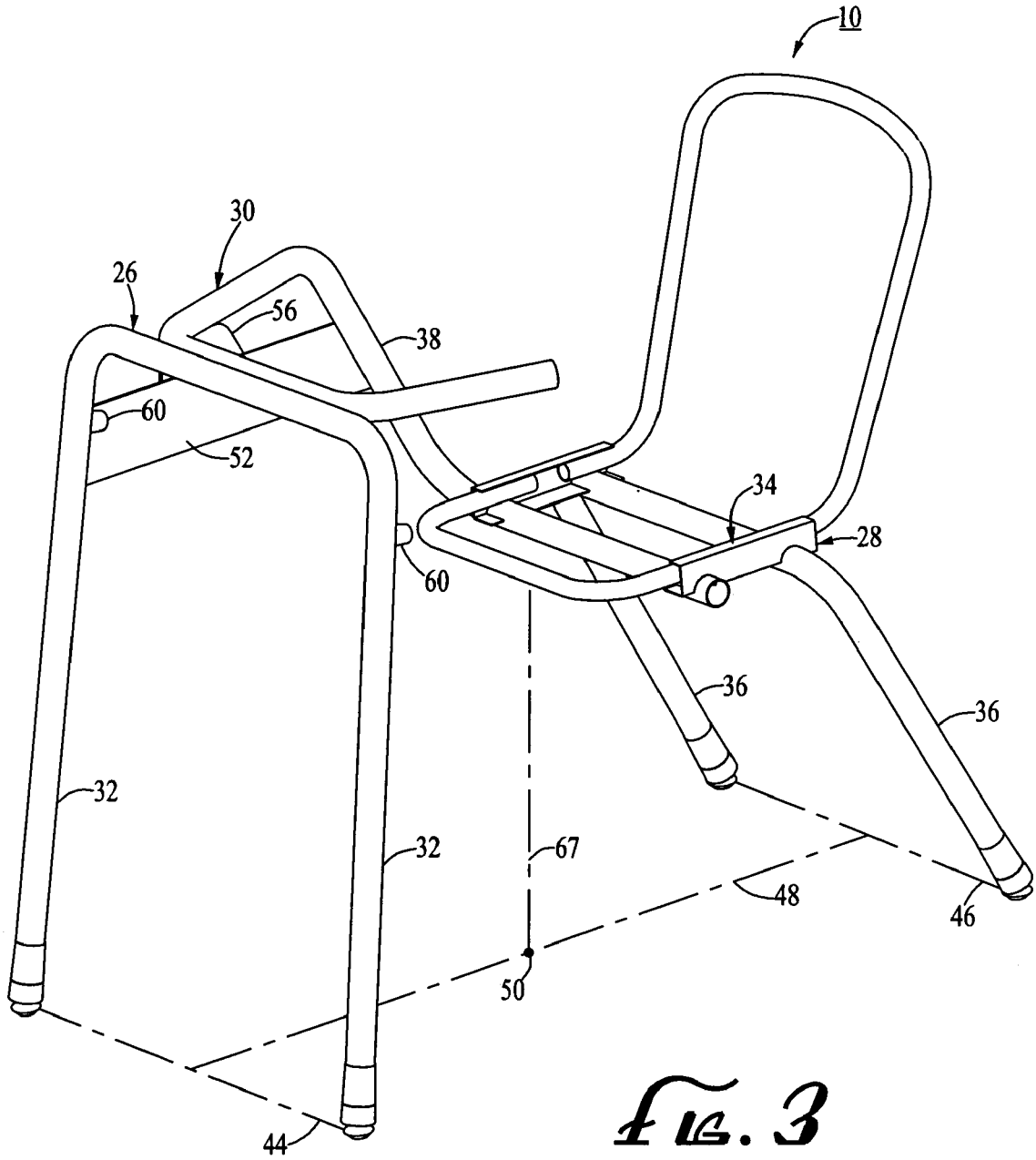
FIG. 3 is a perspective view of a chair-desk frame having features of the invention.
Figure 4:
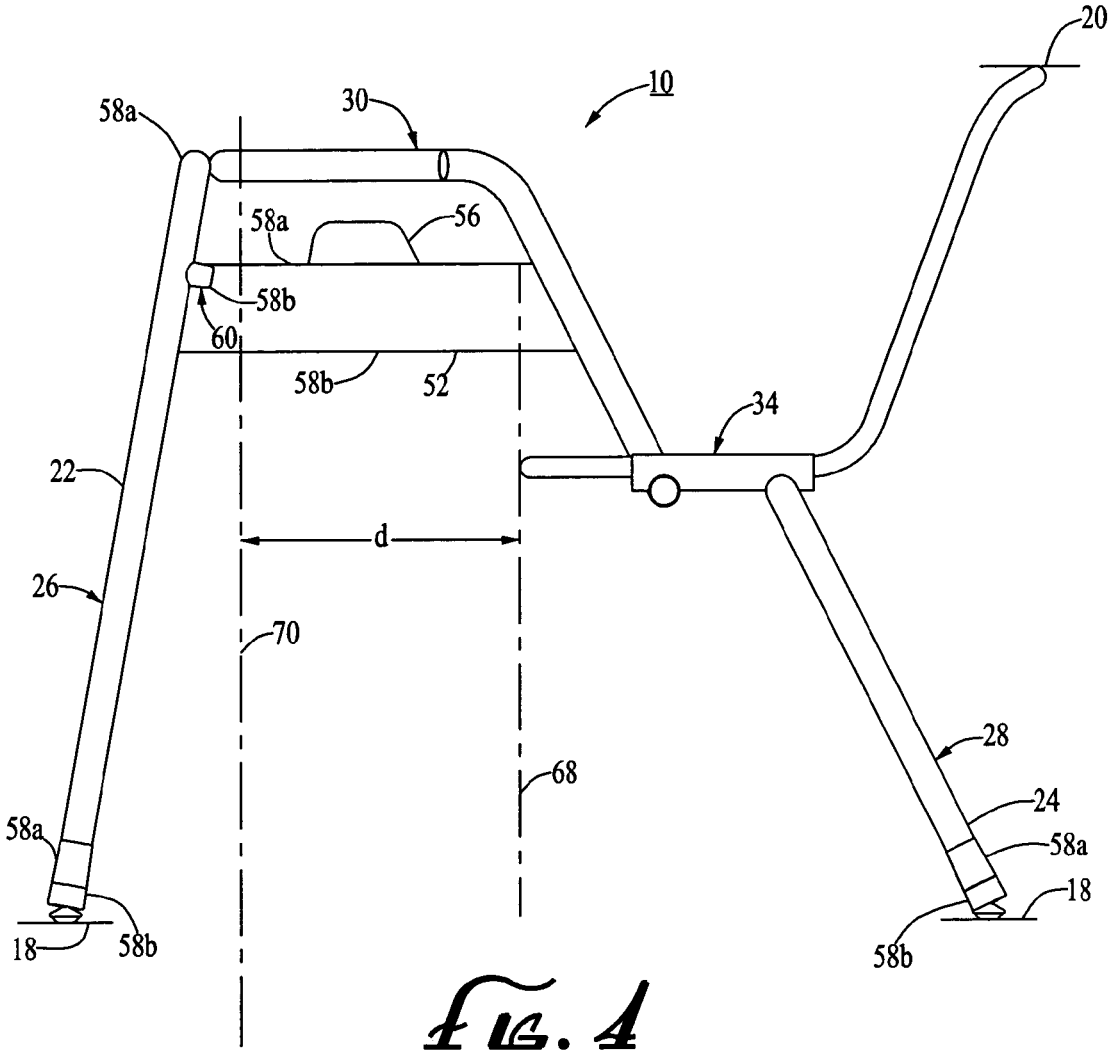
FIG. 4 is a side view of the chair-desk frame illustrated in FIG. 3.
Figure 5:
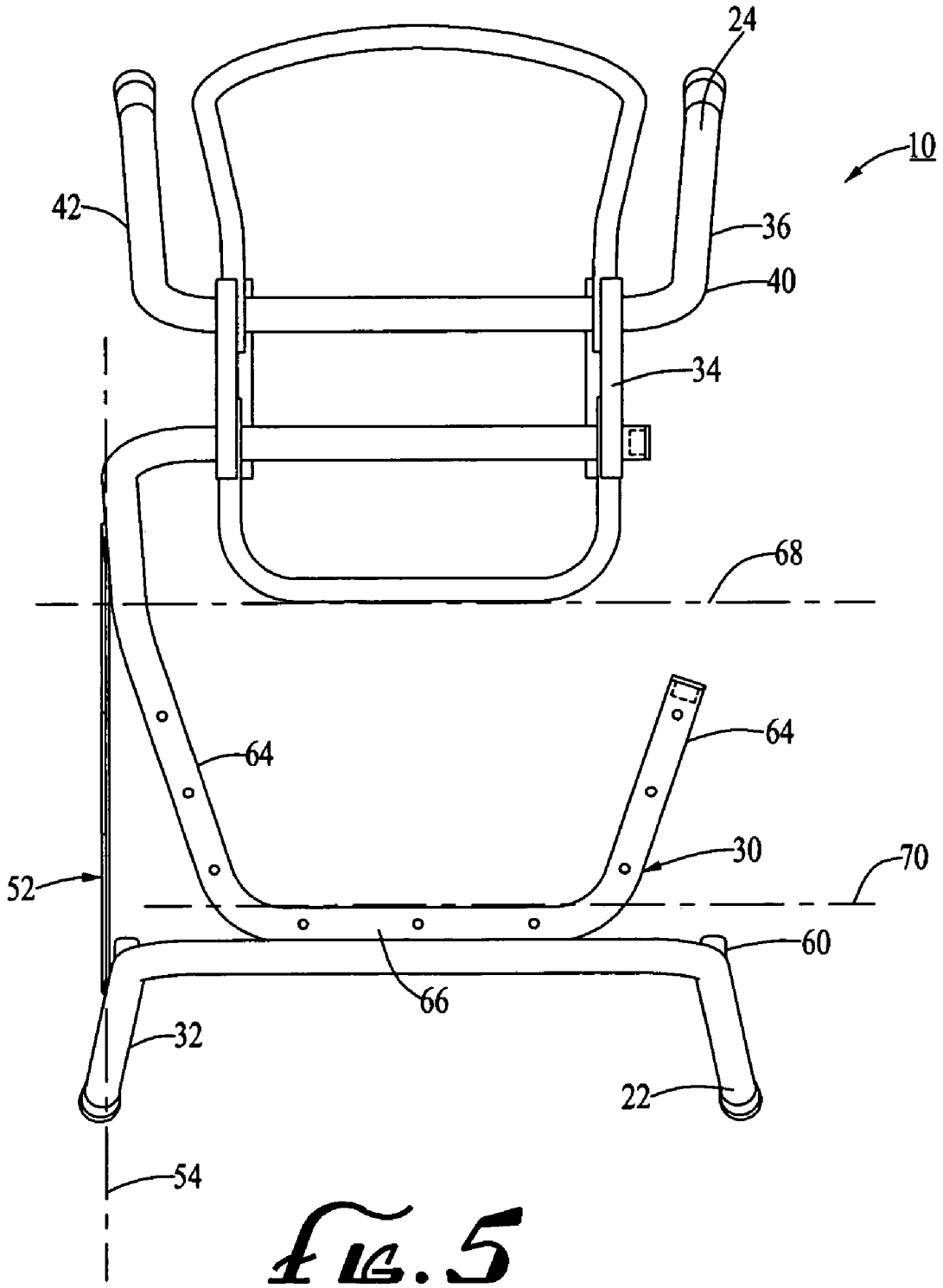
FIG. 5 is a top view of the chair-desk frame illustrated in FIG. 3.
Figure 6:
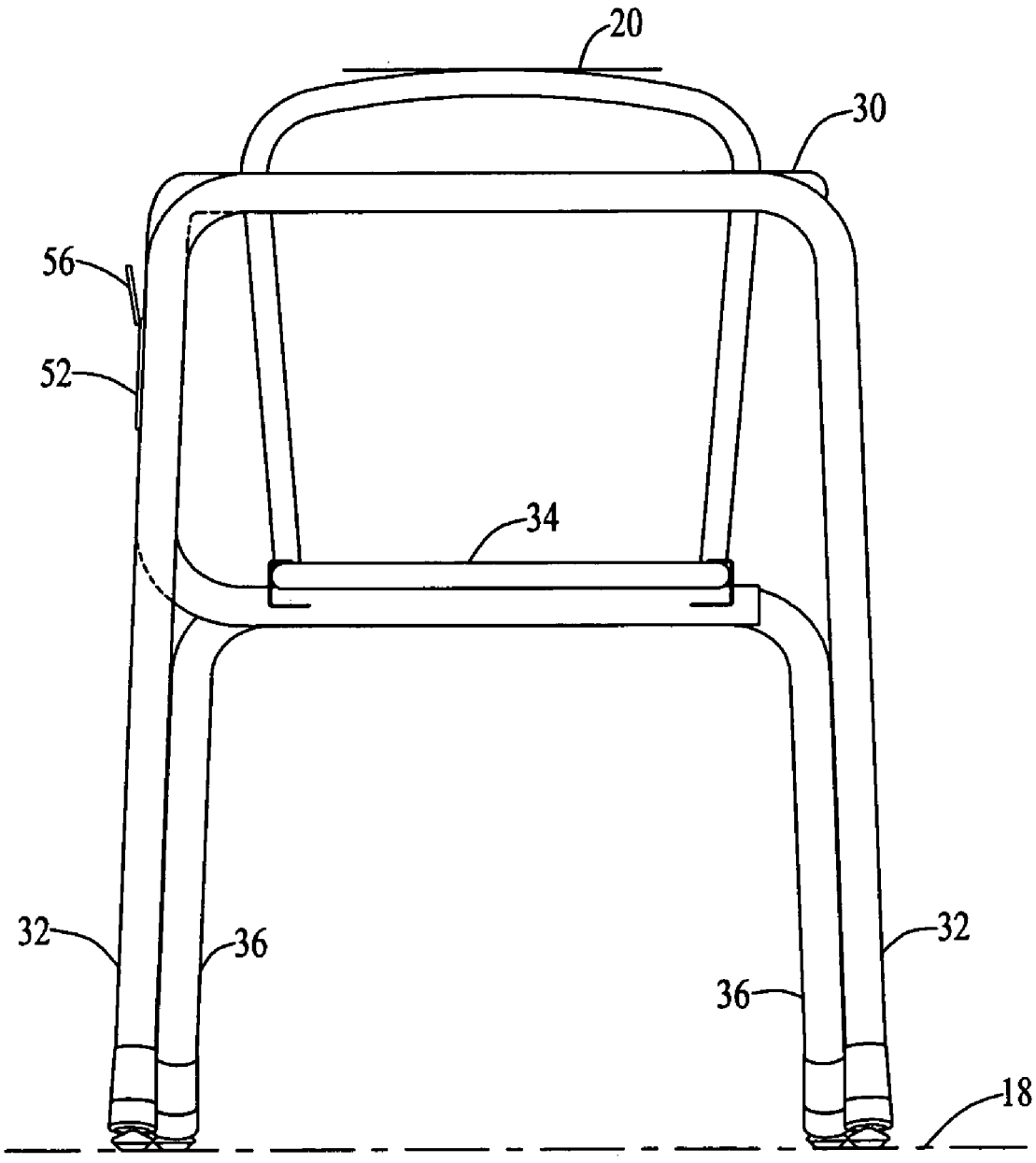
FIG. 6 is a front view of the chair-desk frame illustrated in FIG. 3.

As illustrated in FIG. 3, the pair of front legs 32 define a front leg base connection line 44 extending between the midpoints of the pair of front legs 32 at the base elevation 18. The pair of rearward legs 36 define a rear leg base connection line 46 extending between the center lines of the pair of rear legs 36 at the base elevation 18. A base center line 48 extends between the midpoint of the front leg base connection line 44 and the midpoint of the rear leg base connection line 46. A central base point 50 is defined at the midpoint of the base center line 48.

Figure 7:
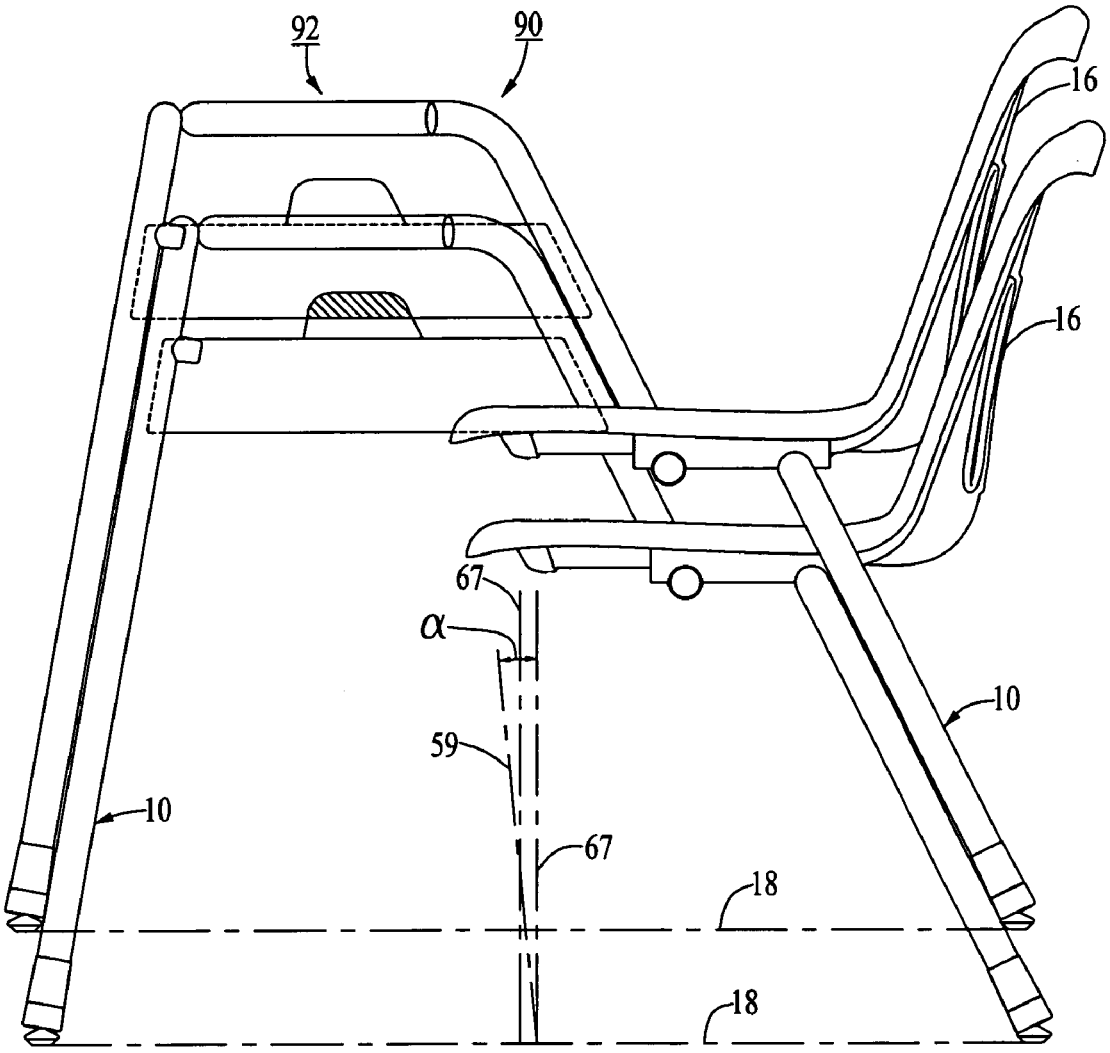
FIG. 7 is a side view of two chair-desk frames, such as illustrated in FIG. 3, stacked atop one another.

The chair-desk frame 10 can further comprise a seat 16 disposed on the seat support structure 34, such as illustrated in FIG. 7, or not, such as illustrated in FIGS. 3–6.

In the embodiment illustrated in FIGS. 3–6, the chair-desk frame 10 further comprises a side brace 52 connecting the distal side of the second side front leg 32 to the distal side of the connecting element 38. The side brace 52 is disposed along or outside a first tangential plane 54 defined between the distal side of the second side front leg 32 and the distal side of the connecting element 38.

In the embodiment illustrated in FIGS. 3–6, the side brace 52 has an upper tang 56 which is disposed outwardly along its upper surface at an acute angle from the vertical. The tang 56 acts as an indexer and stabilizer for another identical chair-desk frame 10 stacked on top of it.

The chair-desk frame 10 further comprises at least three upper stacking points 58*a* and at least three lower stacking points 58*b*. All of the stacking points 58 are disposed so that a plurality of identical chair-desk frames 10 can be vertically stacked one on top of the other, as illustrated in FIG. 7, such that (i) the base elevations 18 of each chair-desk frame 10 in the stack is separated from the base elevation 18 by an adjacent chair-desk frame 10 by less than 45% of the maximum elevation 20, preferably less than 20% of the maximum elevation 20 and most preferably less than about 15% of the maximum elevation 20 and (ii) the locations of all central base points in the stack fall along a generally vertical line 59 which deviates from the vertical in a forward direction by an angle $\propto$ less than 30°, preferably less than 20°, most preferably less than 15°, in a direction towards either side by less than 10°, preferably less than 5° most preferably less than 1°, and in a rearward direction by less than 30°, preferably less than 20° most preferably less than 15°. In the embodiments illustrated in the drawings, the vertical line 59 deviates from the vertical in a forward direction by an angle $\propto$ less than 15°, with no deviation toward either side.

The embodiment illustrated in FIGS. 3–6 provide seven upper stacking points 58*a* and seven lower stacking points 58*b*. The seven upper stacking points 58*a* include a stacking point 58*a* on the forward side of each of the front legs 32 near the base of those legs, stacking points 58*a* at the rearward side of both rear legs 36 near their base and another stacking point 58*a* along the upper side of the side brace 52. The two additional upper stacking points 58*a* are disposed along the forward side of each front leg 32, near the uppermost portion of those legs 32.

The embodiment illustrated in FIGS. 3–6 also has seven lower stacking points 58*b*. Two of those stacking points 58*b* are on the rearward side of each front leg 32 near the base of those legs 32. Two of the lower stacking points 58*b* are disposed on the forward side of each of the rearward legs 36, near the base of those legs 36. A fifth stacking points 58*b* is disposed along the lower side of the side brace 52. The remaining two lower stacking points 58*b* are provided by a pair of stack registers 60, one stack register 60 being disposed on the rearward side of each front leg 32, near the upper portion of those front legs 32. The stack registers 60 are typically made from, or covered by, a soft rubber or plastic material.

Figure 8A:
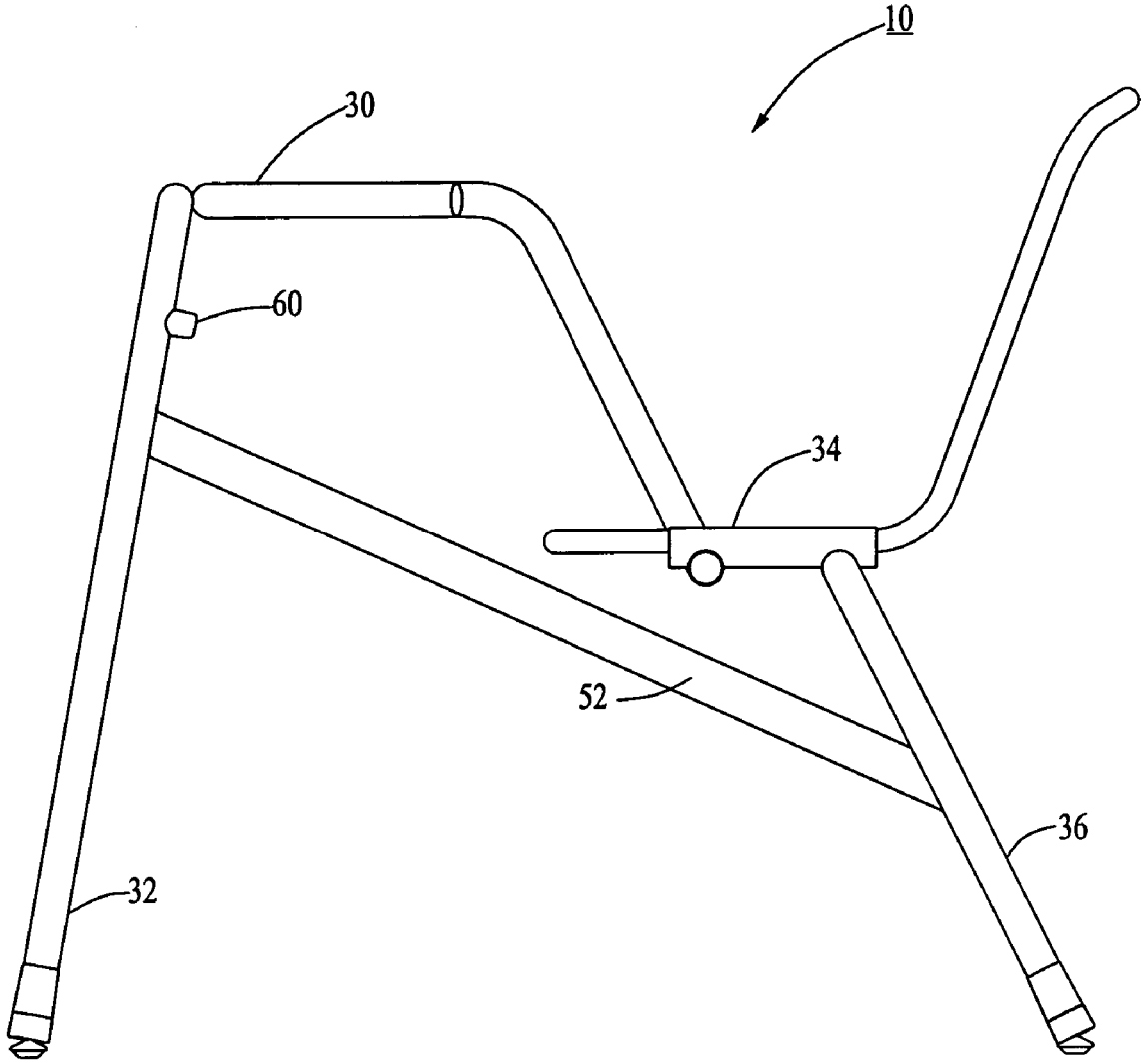
FIG. 8A is a side view of another alternative embodiment of a chair-desk frame having features of the invention.
Figure 8B:
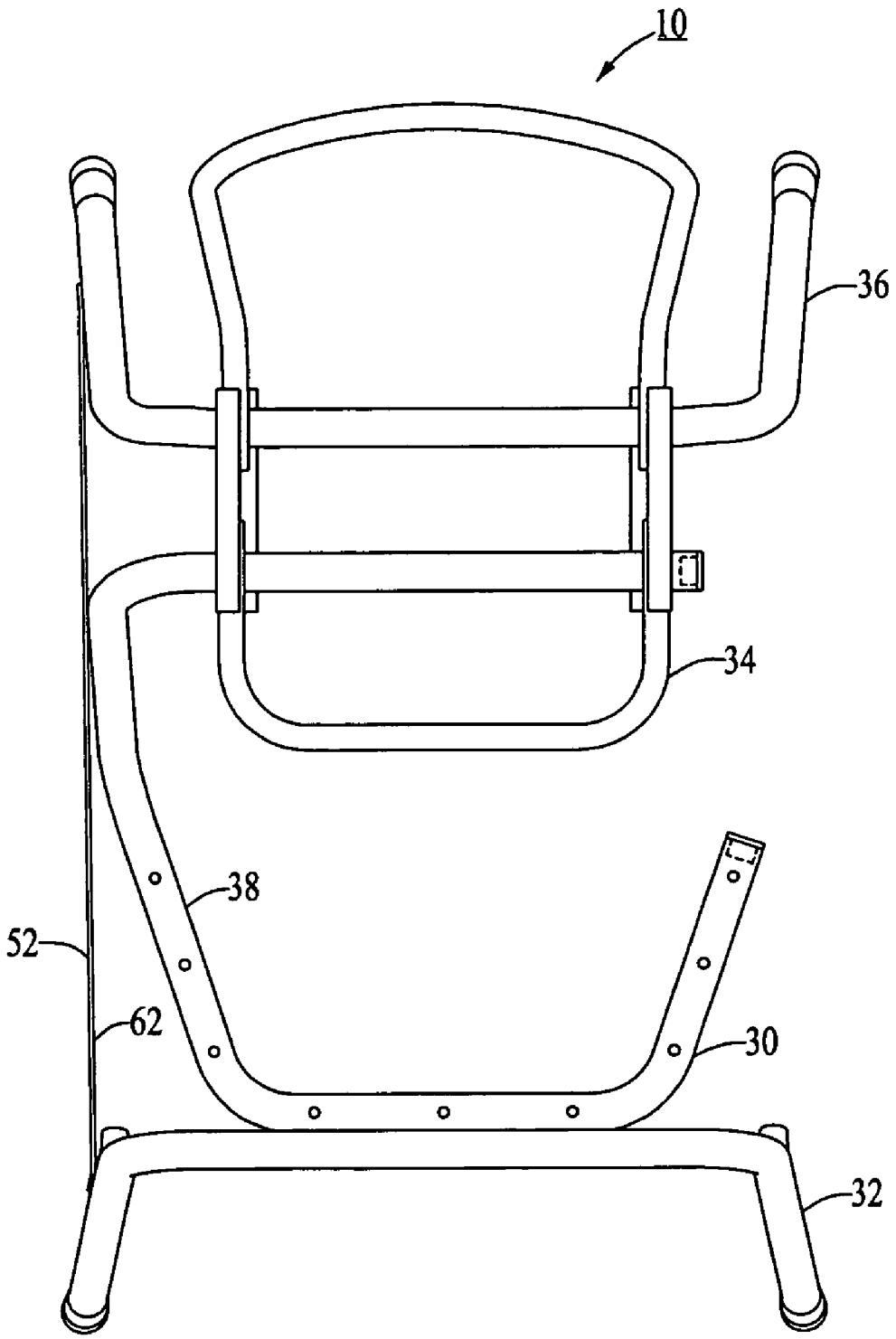
FIG. 8B is a top view of the chair-desk frame illustrated in FIG. 8A.

FIGS. 8A and 8B illustrate an alternative embodiment. In this embodiment, the side brace 52 extends from the distal side of the second front leg 32 to the distal side of the second rear leg 36. The side brace 52 could also include an upper tang 56 (not shown). In the embodiment illustrated in FIGS. 8A and 8B, it is critical that the side brace 52 be disposed along or outwardly of a second tangential plane 62 defined by the distal side of the second front leg 32 and the distal side of the second rear leg 36. It is also critical that the distal side of the connecting element 38 be disposed along such second tangential plane 62 or inwardly thereof.

In the embodiment illustrated in the drawings, the desk top support structure 30 has a generally U-shape with a pair of opposed side members 64 and a transverse member 66. The transverse member 66 is disposed proximate to the forward end 22 of the chair-desk frame 10. Those with skill in the art will recognize that the desk top support structure 30 can take on many other configurations.

In all configurations of the desk top support structure 30, it is important that there be sufficient space rearwardly of any rear-most transverse member in the desk top support structure 30 to allow identical chair-desk frames 10 to be stacked atop one another. Where chair-desk frames 10 are stacked such that vertical lines 67 drawn through each central base point 50 of adjacent chair-desks 12 are separated by a distance d, and wherein the forward-most member of the seat support structure 34 terminates in a first vertical plane 68 and the rearward-most transverse member of the desk-top support structure 34 terminates in a second vertical plane 70, the distance between the first vertical plane 68 and the second vertical plane 70 should be at least d+⅛ inch, preferably d+1 inch and most preferably d+4 inches. Where the chair-desk frames 10 include a seat 16 mounted atop the seat support structure 34, the first vertical plane 68 is defined at the forward-most edge of the seat 16. Thus, if a stack 92 of chair-desk frames 10 "grows" forward at a rate of 2 inches per chair-desk frame 10, the distance between the first vertical plane 68 and the second vertical plane 70 would be 2⅛ inches, preferably 3 inches and most preferably 6 inches.

Figure 9B:
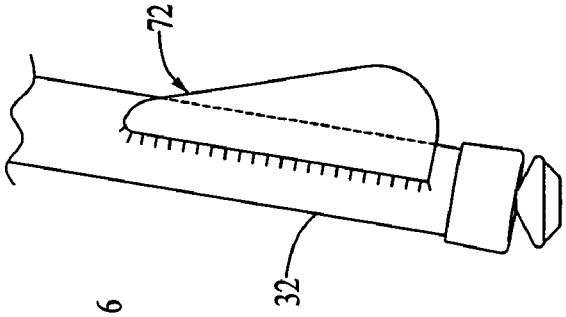
FIG. 9B is a detail view of the front leg of the chair-desk frames illustrated in FIG. 8A.
Figure 9C:
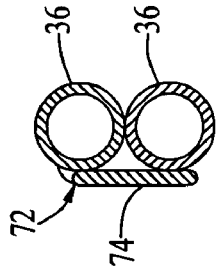
FIG. 9C is a cross-sectional view of the rear legs of the chair-desk frame illustrated in FIG. 9A, taken along line 9C—9C.
Figure 9A:
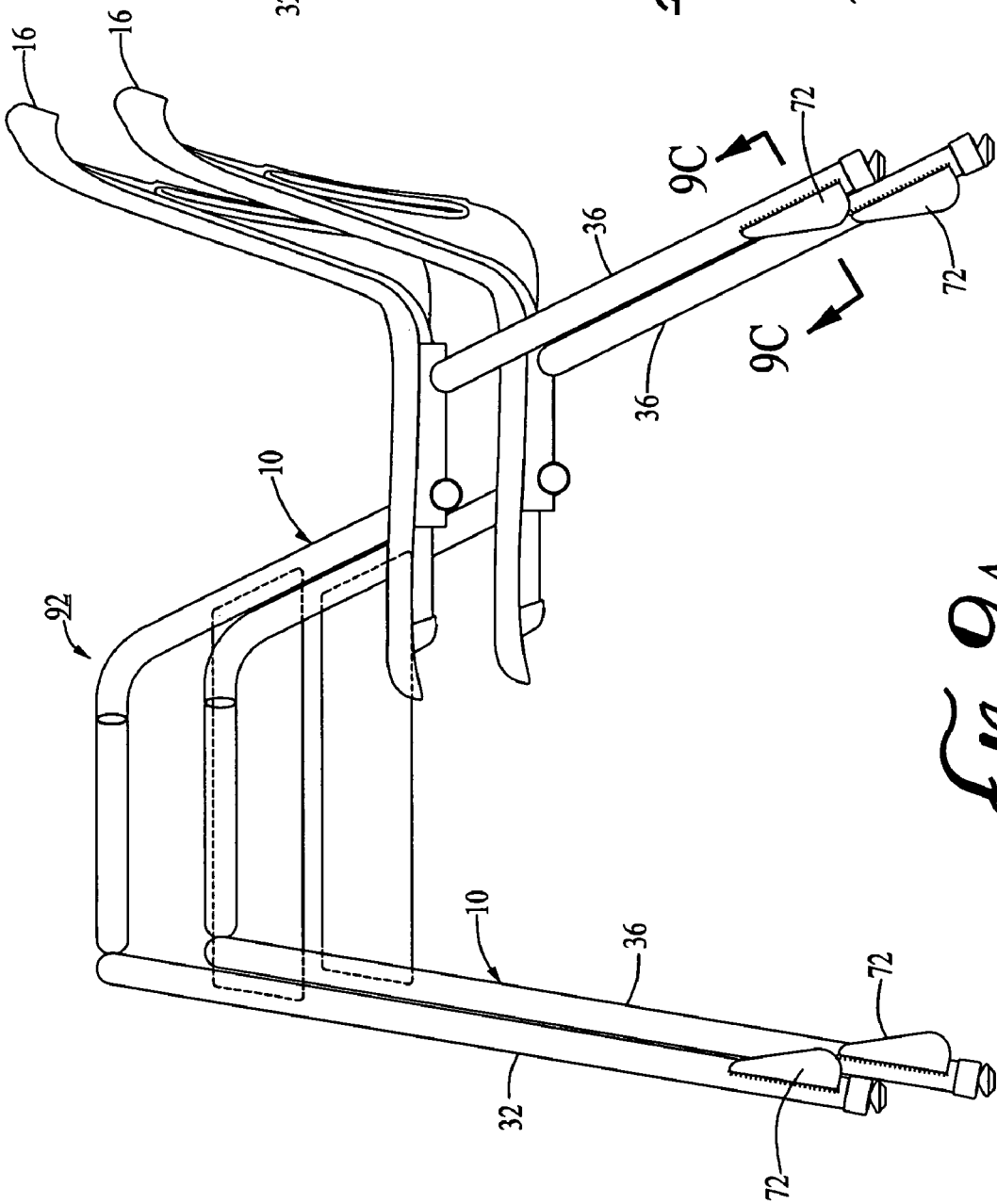
FIG. 9A is a side view of a stack of two alternative chair-desk frames having features of the invention.

FIGS. 9A–9C illustrate an alternative method for stabilizing a stack 92 of chair-desk frames 10. In this embodiment, each leg 32 and 36 has an alignment tab 72 attached to the distal side of that leg, each alignment tab 72 has a planar portion 74 disposed parallel to the base center line 48. The alignment tab 72 can alternatively be attached to the proximal side of the leg(s) 32 and/or 36. As illustrated in the drawings, each alignment tab 72 allows the leg of an adjacent chair-desk frame 10 in the stack 92 to be retained and aligned by the alignment tab 72.

Figure 10B:
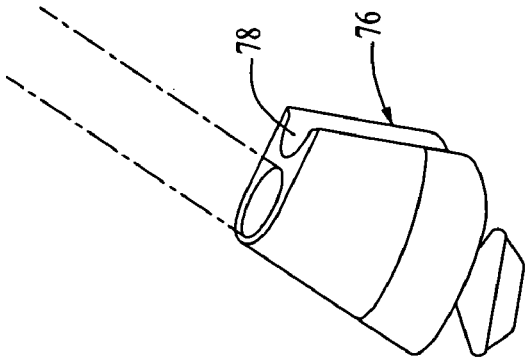
FIG. 10B is a detail view of a foot useable in the chair-desk frames illustrated in FIG. 10A.
Figure 10C:
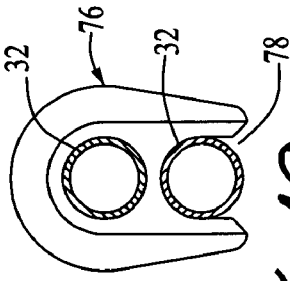
FIG. 10C is a cross-sectional view of the foot illustrated in FIG. 10A, taken along line 10C—10C.
Figure 10A:
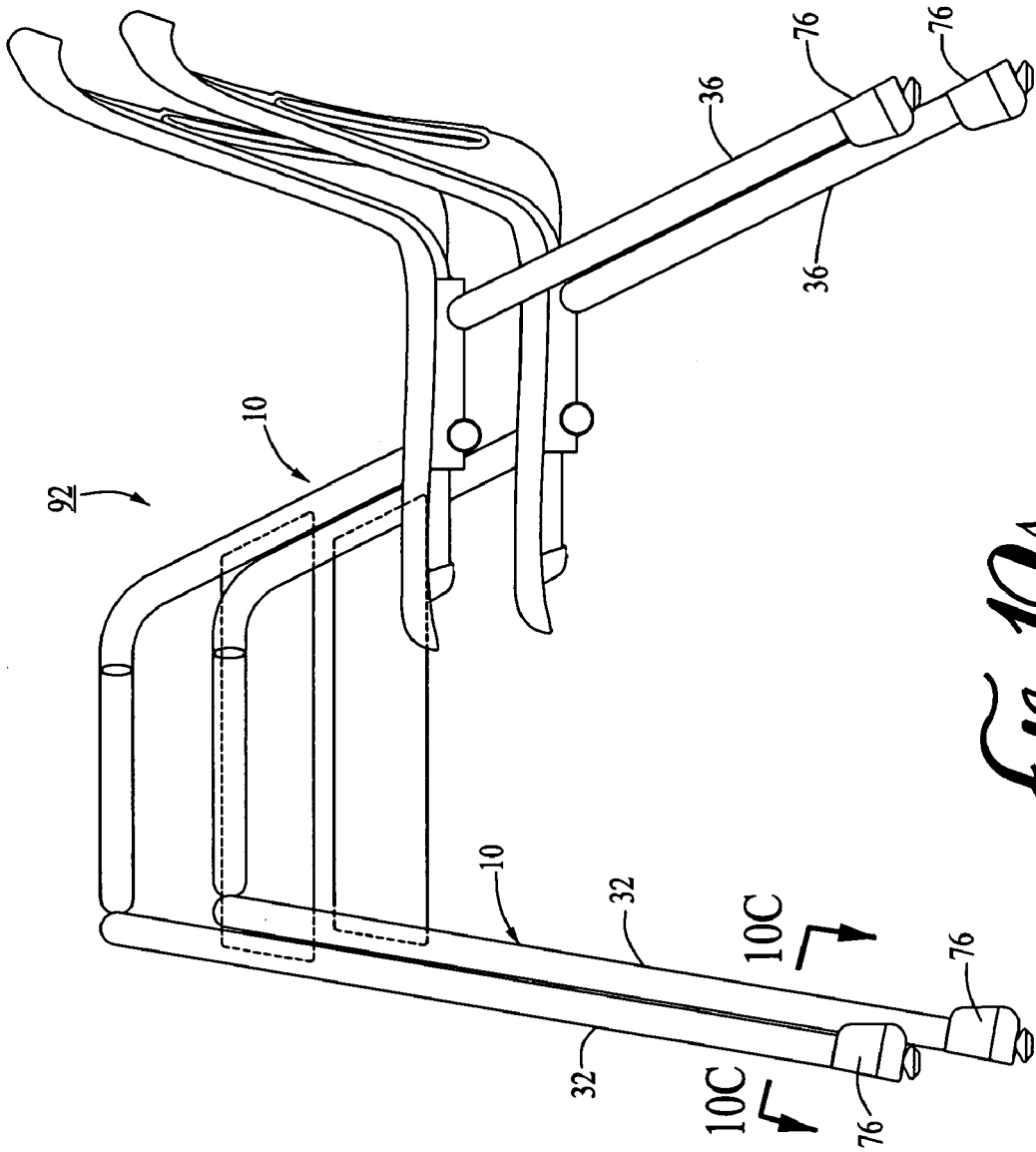
FIG. 10A is a stack of two alternative chair-desk frames having features of the invention.

FIGS. 10A–10C illustrate another alternative embodiment for aligning and stabilizing a stack of chair-desk frames 10. In this embodiment, the chair-desk frame 10 comprises at least one alignment foot 76. The alignment foot 76 has a groove 78 which is sized and dimensioned to accept the leg 32 or 36 of an identical chair-desk frame 10 when the two chair-desk frames 10 are stacked one on top of the other.

FIGS. 11–16C illustrate yet another alternative embodiment for aligning and stabilizing a stack of chair-desk frames 10. In this embodiment, a stack stabilizer 80 is disposed between a first chair-desk frame 10 and a stacked second chair-desk frame 10. The stack stabilizer 80 supports and aligns the stack so that the locations of all of the central base points 50 of the chair-desk frames 10 in the stack 92 fall along a generally vertical line 59 which deviates from the vertical in a forward direction by less than an angle $\propto$ of 30°, in a direction towards either side by less than 10° and in a rearward direction by less than 30°. In the embodiment illustrated in the drawings, each chair-desk frame 10 in this embodiment comprises a front leg transverse member 82 disposed between the pair of front legs 32 of each chair-desk frame 10. The stack stabilizer 80 is configured to attach to the desk top support structure 30 of a first, lower chair-desk frame 10 while supporting the front leg transverse member 82 of a second, upper chair-desk frame 10.

As is illustrated in the drawings, the stack stabilizer 80 can comprise a hook-shaped rearward end 84 which is sized and dimensioned to be retained by the desk top support structure 30 of the first chair-desk frame 10. The stack stabilizer 80 also has a forward 86 end which defines a groove 88. The groove 88 is sized and dimensioned to accept and retain the front leg transverse member 82 of the second chair-desk frame 10. The stack stabilizer 80 is typically made from a plastic or light metal alloy.

The stack stabilizer 80 is typically employed only during the stacking of chair-desk frames 10. After the chair-desk frames 10 are unstacked, the stack stabilizers 80 are recycled for use in the stacking of additional chair-desk frames 10.

Figure 11:
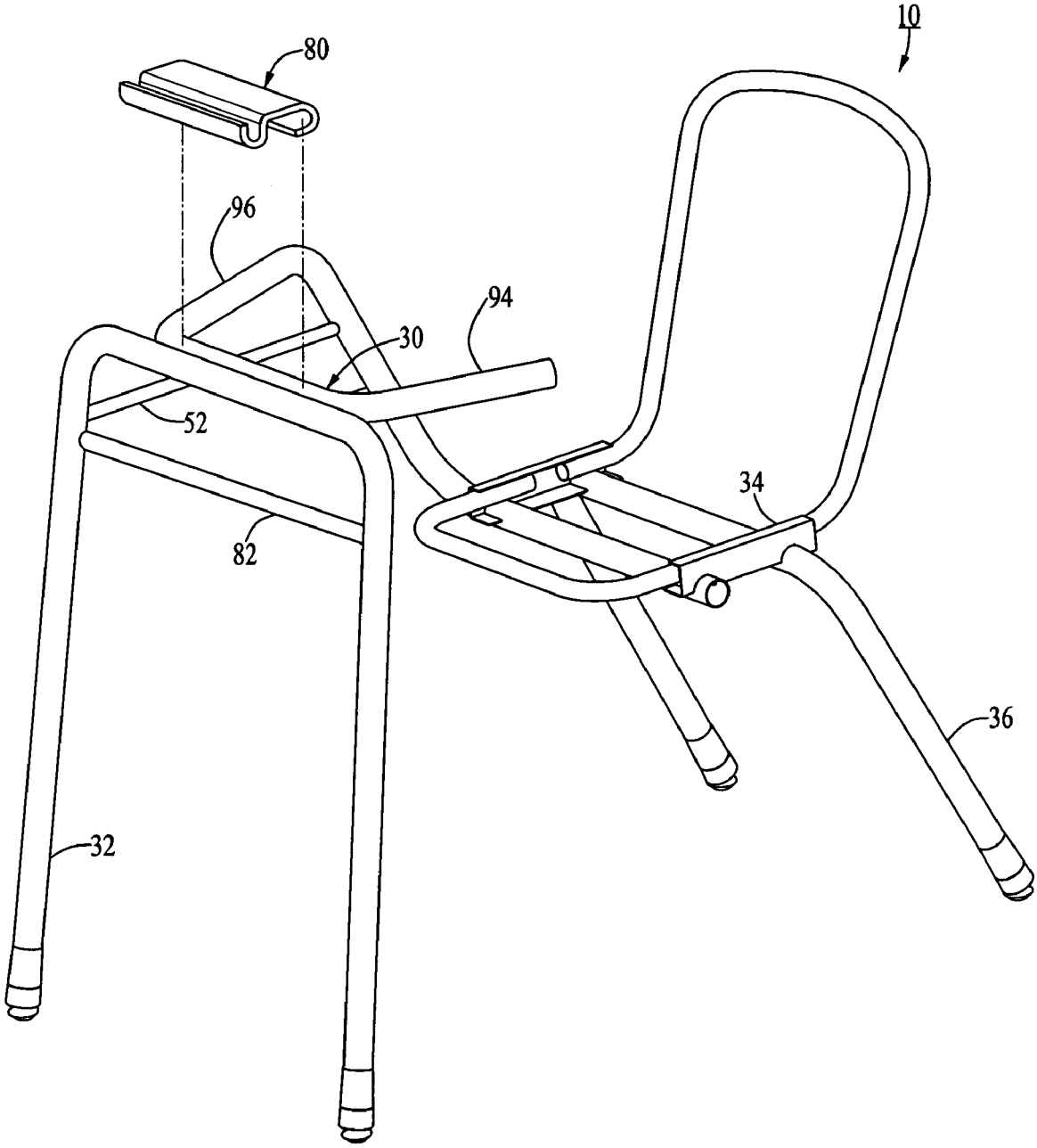
FIG. 11 is a perspective view of yet another alternative chair-desk frame having features of the invention.
Figure 12:
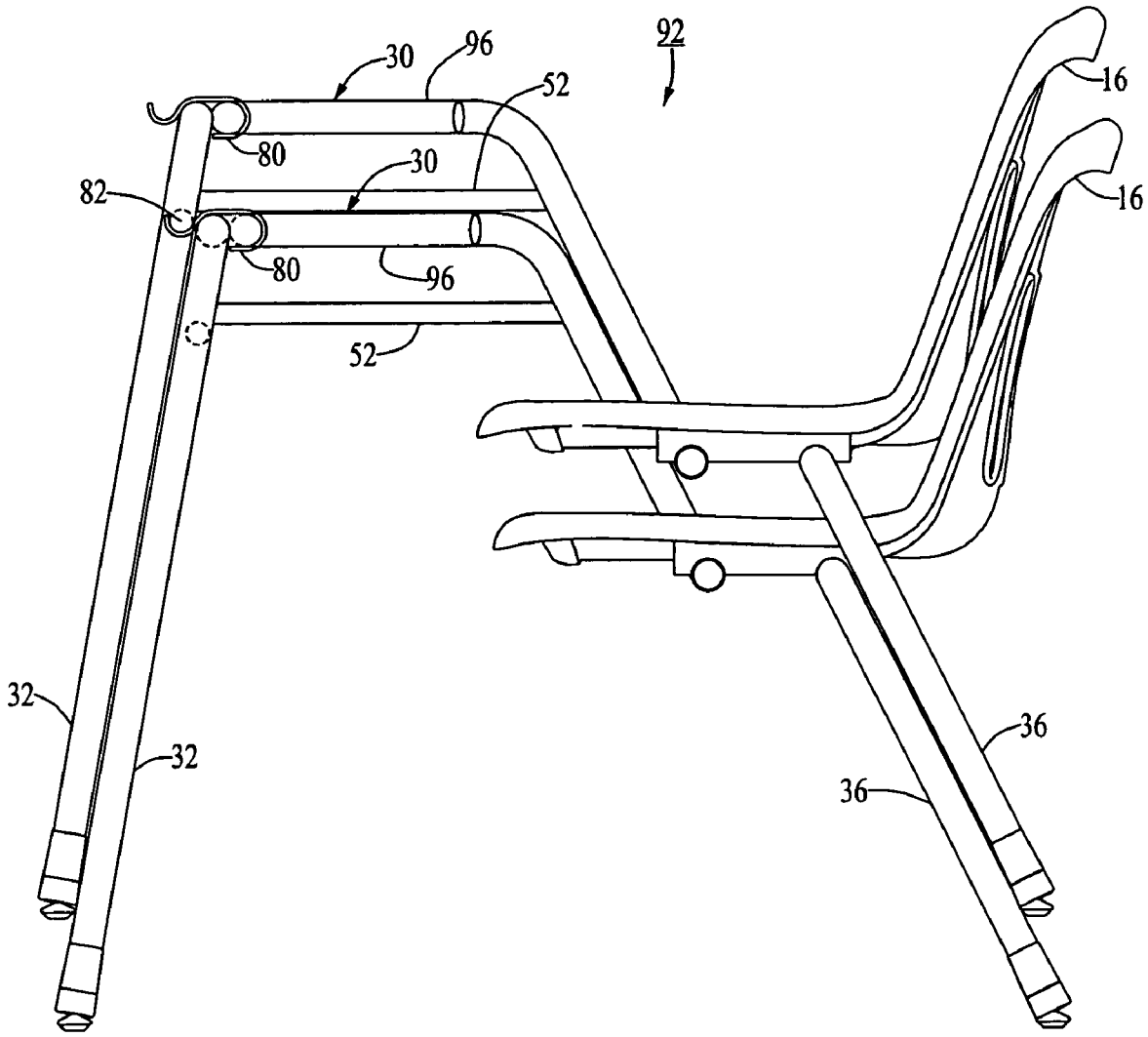
FIG. 12 is a stack of two chair-desk frames of the type illustrated in FIG. 11.

FIGS. 11, 12 and 14 illustrate an embodiment wherein the desk top support structure 30 comprises a generally horizontal first side support member 94 and a generally horizontal second side support member 96. FIGS. 12 and 14 illustrate a stack 92 comprising a first chair-desk frame 10 of this embodiment stacked atop an identical second chair-desk frame 10. In this stack 92, the distance between the lowermost portion of the second side support member 96 of the first chair-desk frame 10 and the uppermost portion of the second side support member 96 of the second chair-desk frame 10 is greater than the distance between the lowermost portion of the second side support member 96 of the first chair-desk frame 10 and the lowermost portion of the side brace 52 of the first chair-desk frame 10.

The invention allows identical chair-desk frames 10 to be nested in any particular orientation. When nested in a vertical orientation, the nest 90 is termed herein a "stack" 92. The nest 90 can also be oriented in a generally horizontal direction or in any suitable angle between the horizontal and the vertical. Nests 90 of as few as two chair-desk frames 10 are possible, as are nests of 10 or more chair-desk frames 10.

The invention allows the manufacturer, shipper and end user to conveniently move nests 90 of chair-desk frames 10 by nesting the chair-desk frames 10 and then moving the nest 90 of chair-desk frames 10 from place to place. The amount of time, energy, space and manpower required to move a large quantity of chair-desk frames 10 is greatly reduced by the ability of the chair-desk frames 10 of the invention to nest with one another.

The advantages of being able to nest the chair-desk frames 10 result in greatly reduced shipping costs and storing costs to the manufacturer, storing costs to the distributor and storing costs to the end user. Also, large savings in handling costs to both the manufacturer and to the end user result from the ability to move large numbers of chair-desk frames 10 in a stacked or otherwise nested configuration.

Having thus described the invention, it should be apparent that numerous structural modifications and adaptations may be resorted to without departing from the scope and fair meaning of the instant invention as set forth hereinabove.

What is claimed is:

1. A chair-desk frame having a chair-desk wherein the chair-desk has a first side and a second side, the first side being open to allow a user ingress and egress from a chair portion of the chair-desk and the second side of the chair-desk being closed, the chair-desk frame comprising:

(a) a rearward portion having a pair of rear legs and a seat support structure;

(b) a forward portion having a pair of front legs and a desk top support structure, the upper portion of both front legs being disposed at an elevation above the seat support structure, the pair of front legs further comprising a first side front leg and a second side front leg, the second side front leg having a distal-most surface;

(c) a connecting element for connecting the forward portion to the rearward portion, the connecting element having a distal-most surface, the distal-most surface of the connecting element and the distal-most surface of the second side front leg defining a tangential plane; and (d) a side brace connecting the second side front leg to the connecting element, the side brace being disposed along or outwardly of the tangential plane;

wherein the chair-desk frame is adapted for nestably stacking with identical chair-desk frames to form a generally vertical chair-desk frame stack comprising at least three identical chair-desk frames.

2. The chair-desk frame of claim 1 further comprising a pair of stack registers, one stack register being disposed on one of the front legs and the other stack register being disposed on the other of the front legs.

3. The chair-desk frame of claim 1 further comprising a generally horizontal seat attached to the seat support structure.

4. The chair-desk frame of claim 1 wherein the desk top support structure has a generally U-shape.

5. The chair-desk frame of claim 1 wherein the chair-desk frame has a forward end and a rearward end, wherein the seat support structure comprises a forward-most member disposed within a first vertical plane and wherein the desk-top support structure comprises a rearward-most transverse member disposed within a second vertical plane, the distance between the first vertical plane and the second vertical plane being at least about 4 inches.

6. The chair-desk frame of claim 1 wherein the chair-desk frame has a forward end and a rearward end, wherein a seat is disposed upon the seat support structure, the seat having a forward-most edge abutting a first vertical plane and wherein the desk-top support structure comprises a rearward-most transverse member disposed within a second vertical plane, the distance between the first vertical plane and the second vertical plane being at least about 4 inches.

7. The chair-desk frame of claim 1 wherein the side brace has an upper tang which is disposed outwardly at an acute angle from the vertical.

8. The chair-desk frame of claim 1 wherein:

(a) the chair-desk frame further comprises a pair of stack registers, one stack register disposed on one of the front legs and the other stack register being disposed on the other of the front legs;

(b) the desk top support structure has a generally U-shape; and (c) the side brace has an upper tang which is disposed outwardly at an acute angle from the vertical;

whereby an identical chair-desk can be stacked atop the chair-desk and be aligned or supported in part by the stack registers and by the side brace.

9. The chair-desk frame of claim 1 wherein the chair-desk frame is a first chair-desk frame and wherein the stacking of an identical second chair-desk frame upon the first chair-desk frame yields a stack of the two chair-desk frames having a height which is less than about 1.45 of the height of the first chair-desk.

10. A chair-desk frame having a chair-desk wherein the chair-desk has a first side and a second side, the first side being open to allow a user ingress and egress from a chair portion of the chair-desk and the second side of the chair-desk being closed, the chair-desk frame comprising:

(a) a rearward portion having a pair of rear legs and a seat support structure, the pair of rear legs comprising a first side rear leg and a second side rear leg, the second side rear leg having a distal-most surface;

(b) a forward portion having a pair of front legs and a desk top support structure, the upper portion of both front legs being disposed at an elevation above the seat support structure, the pair of front legs further comprising a first side front leg and a second side front leg, the second side front leg having a distal-most surface, the distal-most surface of the second side rear leg and the distal-most surface of the second side front leg defining a tangential plane; and (c) a side brace connecting the second side front leg to the second side rear leg, the side brace being disposed along or outwardly of the tangential plane;

wherein the chair-desk frame is adapted for nestably stacking with identical chair-desk frames to form a generally vertical chair-desk frame stack comprising at least three identical chair-desk frames.

11. The chair-desk frame of claim 10 further comprising a pair of stack registers, one stack register being disposed on one of the front legs and the other stack register being disposed on the other of the front legs.

12. The chair-desk frame of claim 10 further comprising a seat attached to the seat support structure.

13. The chair-desk frame of claim 10 wherein the desk top support structure has a generally U-shape.

14. The chair-desk frame of claim 10 wherein the chair-desk frame has a forward end and a rearward end, wherein the seat support structure comprises a forward-most member disposed within a first vertical plane and wherein the desk-top support structure comprises a rearward-most transverse member disposed within a second vertical plane, the distance between the first vertical plane and the second vertical plane being at least about 4 inches.

15. The chair-desk frame of claim 10 wherein the chair-desk frame has a forward end and a rearward end, wherein a seat is disposed upon the seat support structure, the seat having a forward-most edge abutting a first vertical plane and wherein the desk-top support structure comprises a rearward-most transverse member disposed within a second vertical plane, the distance between the first vertical plane and the second vertical plane being at least about 4 inches.

16. The chair-desk frame of claim 10 wherein the side brace has an upper tang which is disposed outwardly at an acute angle from the vertical.

17. The chair-desk frame of claim 10 wherein:

(a) the chair-desk frame further comprises a pair of stack registers, one stack register disposed on one of the front legs and the other stack register being disposed on the other of the front legs;

(b) the desk top support structure has a generally U-shape; and (c) the side brace has an upper tang which is disposed outwardly at an acute angle from the vertical;

whereby an identical chair-desk can be stacked atop the chair-desk and be aligned or supported in part by the stack registers and by the side frame.

18. The chair-desk frame of claim 10 wherein the chair-desk frame is a first chair-desk frame and wherein the stacking of an identical second chair-desk frame upon the first chair-desk frame yields a stack of the two chair-desk frames having a height which is less than about 1.45 of the height of the first chair-desk.

19. A chair-desk frame stack comprising:

(a) a first chair-desk frame stacked on top of a second, identical chair-desk frame, each chair-desk frame comprising:

(i) a rearward portion having a seat support structure and a pair of rear legs, the pair of rear legs defining a rear leg base connection line extending between the center lines of the pair of rear legs at the base elevation; and (ii) a forward portion attached to the rearward portion, the forward portion having a desk top support structure and a pair of front legs, the upper portion of both front legs being disposed at an elevation above the seat support structure, the pair of front legs defining a front leg base connection line extending between the midpoints of the pair of front legs at the base elevation;

wherein the chair-desk frame defines (i) a base center line extending between the midpoints of the front leg base connection line and the rear leg base connection line, and (ii) a central base point at the midpoint of the base center line;

(b) a stack stabilizer disposed between the first chair-desk frame and the second chair-desk frame which supports and aligns the stack so that the locations of all central base points in the stacks fall along a generally vertical line which deviates from the vertical in a forward direction by less than 30°, in a direction towards either side by less than 10° and in a rearward direction by less than 30°.

20. The chair-desk frame stack of claim 19 wherein each chair-desk frame comprises a front leg transverse member disposed between the pair of front legs and wherein the stack stabilizer attaches to the desk top support structure of the second frame and supports the front leg transverse member of the first frame.

21. The chair-desk frame stack of claim 19 wherein the stack stabilizer comprises a hook-shaped rearward end, sized and dimensioned to be retained by the desk top support structure of the second frame and a forward end having a groove which is sized and dimensioned to accept and retain the front leg transverse member of the first frame.

22. A method for moving a plurality of chair-desk frames from a first location to a second location, the method comprising the steps of:

(a) providing a plurality of identical chair-desk frames, each chair-desk frame comprising:

(i) a rearward portion having a pair of rear legs and a seat support structure;

(ii) a forward portion having a pair of front legs and a desk top support structure, the upper portion of both front legs being disposed at an elevation-above the seat support structure, the pair of front legs comprising a first side front leg and a second side front leg, the second side front leg having an exterior-most surface;

(iii) a connecting element for connecting the forward portion to the rearward portion, the connecting element having an outermost surface, the outermost surface of the connecting element and the outermost surface of the second side front leg defining a tangential plane; and (iv) a side brace connecting the second side front leg to the connecting element, the side brace being disposed along or outwardly of the tangential plane;

wherein the chair-desk frame is adapted for nesting with identical chair-desk frames to form a generally vertical chair-desk frame stack comprising at least three identical chair-desk frames;

(b) nesting the plurality of identical chair-desk frames to form a nest of chair-desk frames; and (c) moving the nest of chair-deck frames from the first location to the second location.

23. The method of claim 22 wherein the nest of chair-desk frames formed in step (b) is a generally vertical nest.

24. The method of claim 22 wherein the nest of chair-desk frames formed in step (b) is a generally horizontal nest.

25. A method for moving a plurality of chair-desk frames from a first location to a second location, the method comprising the steps of:

(a) providing a plurality of identical chair-desk frames, each chair-desk frame comprising:

(i) a rearward portion having a pair of rear legs and a seat support structure, the pair of rear legs comprising a first side rear leg and a second side rear leg, the second side rear leg having a distal-most surface;

(ii) a forward portion having a pair of front legs and a desk top support structure, the upper portion of both front legs being disposed at an elevation above the seat support structure, the pair of front legs further comprising a first side front leg and a second side front leg, the second side front leg having a distal-most surface, the distal-most surface of the second side rear leg and the distal-most surface of the second side front leg defining a tangential plane; and (iii) a side brace connecting the second side front leg to the second side rear leg, the side brace being disposed along or outwardly of the tangential plane;

wherein the chair-desk frame is adapted for nestably stacking with identical chair-desk frames to form a generally vertical chair-desk frame stack comprising at least three identical chair-desk frames;

(b) nesting the plurality of identical chair-desk frames to form a nest of chair-desk frames; and (c) moving the nest of chair-desk frames from the first location to the second location.

26. The method of claim 25 wherein the nest of chair-desk frames formed in step (b) is a generally vertical nest.

27. The method of claim 25 wherein the nest of chair-desk frames formed in step (b) is a generally horizontal nest.

28. A chair-desk frame having a chair-desk wherein the chair-desk has a first side and a second side, the first side being open to allow a user ingress and egress from a chair portion of the chair-desk and the second side of the chair-desk being closed, the chair-desk frame comprising:

(a) a rearward portion having a pair of rear legs and a seat support structure;

(b) a forward portion having a pair of front legs and a desk top support structure, the upper portion of both front legs being disposed at an elevation above the seat support structure, the pair of front legs further comprising a first side front leg and a second side front leg, the desk top support structure comprising a generally horizontal second side support member;

(c) a connecting element for connecting the forward portion to the rearward portion;

(d) a generally horizontal side brace connecting the second side front leg to the connecting element;

wherein the chair-desk frame is adapted for nestably stacking with identical chair-desk frames to form a generally vertical chair-desk frame stack comprising at least three identical chair-desk frames; and wherein when a first chair-desk frame is stacked atop an identical second chair-desk frame, the distance between the lowermost portion of the second side support member of the first chair-desk frame and the uppermost portion of the second side support member of the second chair-desk frame is greater than the distance between the lowermost portion of the second side support member of the first chair-desk frame and the lowermost portion of the side brace of the first chair-desk frame.

* * * * *